US009682406B2

(12) United States Patent
Doublet et al.

(10) Patent No.: US 9,682,406 B2
(45) Date of Patent: Jun. 20, 2017

(54) SELECTIVE SORTING METHOD

(71) Applicant: Veolia Environnement-VE, Paris (FR)

(72) Inventors: Jérémy Doublet, Ayguesvives (FR); Christophe Gambier, Blagnac (FR); Jean-François Rezeau, Toulouse (FR); Alexander Mallinson, Nantes (FR)

(73) Assignee: VEOLIA ENVIRONNEMENT-VE, Paris (FR)

( * ) Notice: Subject to any disclaimer, the term of this patent is extended or adjusted under 35 U.S.C. 154(b) by 56 days.

(21) Appl. No.: 15/040,220

(22) Filed: Feb. 10, 2016

(65) Prior Publication Data

US 2016/0228921 A1 Aug. 11, 2016

(30) Foreign Application Priority Data

Feb. 10, 2015 (FR) ..... 15 51084

(51) Int. Cl.

| | |
|---|---|
| ***B07C 5/00*** | (2006.01) |
| ***B07C 5/342*** | (2006.01) |
| ***B07C 5/34*** | (2006.01) |
| ***B07C 5/02*** | (2006.01) |
| ***B07C 7/00*** | (2006.01) |

(52) U.S. Cl.

CPC ..... *B07C 5/342* (2013.01); *B07C 5/02* (2013.01); *B07C 5/3416* (2013.01); *B07C 7/005* (2013.01)

(58) Field of Classification Search

CPC ..... B07C 5/34; B07C 5/342; B07C 5/3416; B07C 7/005

USPC ..... 209/509, 546, 576

See application file for complete search history.

(56) References Cited

U.S. PATENT DOCUMENTS

| | | | | |
|---|---|---|---|---|
| 5,608,818 A * | 3/1997 | Chini | B25J 9/1697 | 348/95 |
| 8,177,069 B2 * | 5/2012 | Valerio | B07C 5/3416 | 209/11 |
| 9,026,234 B2 * | 5/2015 | Suzuki | B25J 9/1669 | 700/1 |
| 2015/0258684 A1 * | 9/2015 | Harada | B25J 9/1612 | 700/259 |

(Continued)

FOREIGN PATENT DOCUMENTS

| | | |
|---|---|---|
| WO | WO 98/19799 | 5/1998 |
| WO | WO 2009/068792 | 6/2009 |

OTHER PUBLICATIONS

Search Report dated Dec. 3, 2015 out of corresponding French priority Application No. 1551084 (6 pages).

(Continued)

*Primary Examiner* — Terrell Matthews

(74) *Attorney, Agent, or Firm* — Brinks Gilson & Lione; G. Peter Nichols

(57) ABSTRACT

A selective sorting method is described to identify and sort material objects of different natures, sizes and shapes having the form of a pile. The method is characterized in that the attribution of the nature of the object to be sorted includes in capturing at least one two-dimensional image wherein the object appears, using at least one sensor for electromagnetic radiation and in diffusing at least one of the two-dimensional images on a display screen that can be observed by an operator, the operator attributing a nature to the object viewed. A device able to implement the method is also described.

7 Claims, 4 Drawing Sheets

(56) References Cited

U.S. PATENT DOCUMENTS

2015/0375269 A1* 12/2015 Adams ..... B07C 5/3425
209/577

OTHER PUBLICATIONS

Search Report dated Dec. 3, 2015 out of French Application No. 1551082 (6 pages).

* cited by examiner

SELECTIVE SORTING METHOD

This application claims priority to French Patent Application No. 1551084 filed Feb. 10, 2015, the entire contents of which is incorporated herein by reference.

BACKGROUND

This invention generally relates to a selective sorting method in order to identify and sort material objects of different natures, sizes, weights and shapes. This invention also relates to a device able to implement such a method of sorting.

More precisely, the invention relates to a selective sorting method for a set of objects in the form of a pile.

SUMMARY

Sorting objects, when it is performed manually is a physically intense activity, resulting in the repetition at a high speed of relatively ample and repetitive gestures, calling substantially on the limbs, in particular the upper limbs.

The repetition of these gestures can be at the origin of musculoskeletal disorders that should be avoided as much as possible in order to reduce as much as possible any injury or discomfort caused by this manual sorting.

In addition the manual gripping of objects imposes the presence of operators in the same space as the objects to be sorted, which directly exposes the operators to risks of all natures (physical damage, cuts, punctures, dirt, dust, etc.) generated by the objects to be sorted.

The wearing of personal protective equipment (PPE), as well as the layout of workstations (adequate ventilation and infrastructure in particular) are of course of a nature to reduce these risks, but cannot entirely suppress them.

As such, in order to reduce the discomfort caused by manual sorting, and in order to facilitate the displacement of cumbersome objects and of substantial weight, hydraulic machines can be used in sorting zones. As an example of hydraulic machines, mention can be made of construction equipment such as cranes, or hydraulic shovels. However, these machines do not make it possible to achieve satisfactory levels of performance and productivity. Furthermore, it is difficult to accurately control the extraction of an object in particular and to be able to observe it entirely during its displacement.

That is why automated systems are developed in industry with the purpose, in particular, to reduce human exposure to dangerous or potentially dangerous situations, to replace the manual operations in tedious and repetitive tasks, but also in order to increase the sorting performance in terms of quality or/and productivity. For example, in the agro-food sector, robotic systems are used to effectively and rapidly sort fruits and vegetables according to various predefined criteria, in particular physical criteria, such as the shape, the size or the level of maturity of an organic product.

On an industrial scale, current automatic sorting does not make it possible to take into consideration all of the aforementioned criteria simultaneously.

Typically, in the field of processing waste, automatic sorting must be combined with human operations. More precisely, an operator has to intervene, often at the end of the chain, in order to sort each one of the pieces of waste since he alone can recognize all of the objects, while automated sorting machines can only identify a certain number of predefined objects.

To this effect, substantial progress has been made on automatic sorting devices, i.e. that automate certain tasks.

Automatic sorting devices and the sorting methods that implement them, are known to those skilled in the art. For example, international application WO 98/19799 discloses a method as well as a device for selectively sorting waste with a remote operator, comprising means for designating on a touch-sensitive screen an object to be extracted, and means for selective extraction controlled by designation on the touch-sensitive screen of the object. This designation allows for sorting at a distance, i.e. any manual grasping of any object does not require the presence of an operator in the same space as the objects.

Moreover, more recently, international application WO 2009/068792 describes a method as well as a selective sorting device that improves those described in WO 98/19799, by making it possible in particular at very high speed. More particularly, in the device of WO 2009/068792, it is possible to modify the visual appearance of an image of a targeted object on a video screen.

However, note that these devices known in prior art do not make it possible to sort a pile that can contain objects of different shapes and/or different sizes and/or different natures. Indeed, these devices allow only for the sorting of objects that are presented beforehand in unitary form.

More generally, it is known to those skilled in the art automated sorting devices that make it possible to sort objects of different natures, weights or shapes such as waste, only if these objects are presented beforehand in unitary form. In this configuration, all of the objects are separated from one another, in such a way that it is possible to distinguish the contour of them and the objects that remain in the form of a pile are sorted manually at the end of the sorting chain.

As such, there is a real need to propose a method and a device that makes it possible to sort a pile that can contain objects of different sizes and/or shapes and/or natures, in particular waste, by allowing for an increase in the productivity and in the effectiveness of any sorting method of prior art, while still reducing, and even suppressing the physical arduousness of the sorting thanks to the use of interfaces rather than contacts between the objects and the operators.

Note that pile, in the sense of this invention, means a set of entangled heterogeneous objects and arranged randomly on top of one another, said objects being waste.

In this context, the applicant has developed a method that overcomes the disadvantages of prior art and meets the objectives mentioned hereinabove.

More particularly, this invention has for object a selective sorting method in order to identify and sort material objects of different natures, sizes, and shapes and having the form of a pile, said method comprising the following steps:

(a) supplying a flow of objects in the form of a pile, to a zone of vision that comprises at least two sensors for measuring electromagnetic radiation, said zone being located in the zone of action of a robot provided with one or several gripping members;

(b) capturing at least two two-dimensional images of the pile contained in said zone of vision using said sensors for measuring electromagnetic radiation, in order to reconstruct a virtual or electronic image of the pile of objects in the zone of vision that can be viewed on a screen;

(c) processing the information resulting from said two-dimensional images, and identifying all of the possible gripping zones associated with objects present in the pile for said gripping member or members of said robot, without seeking to know the nature of said objects;

(d) locating, in position and orientation, said possible gripping zones, and (e) choosing one of the gripping zones;

(f) defining automatically, for a given gripping member, a trajectory for gripping an object corresponding to the gripping zones chosen;

(g) grasping the corresponding unitary object according to the defined trajectory;

(h) displacing said grasped unitary object to a receiving zone;

(i) displacing said unitary object located in said receiving zone towards an outlet according to the nature;

said method being characterized in that the nature of the object gripped or that is to be gripped by the robot is defined and attributed between the steps (e) and (i), and consists in capturing at least one two-dimensional image wherein said object appears, using at least one two-dimensional image sensor and in diffusing at least one of said two-dimensional images on a display screen that can be observed by an operator, said operator attributing a nature to said object viewed.

Note that the pile of objects that can be sorted by the method according to the invention can for example contain, in a non-limiting manner, cumbersome objects or objects of small sizes, of waste whether industrial or domestic.

As such, waste, in the sense of the invention, means any object, or more generally any movable item, of which the holder discards or of which the holder has the intention or the obligation to discard, for the purposes of valorization or elimination, whether the holder be an industrialist, a collective unit or a private individual.

The objects of the pile that can be sorted by the method according to the invention are for example household waste whether or not organic, electronic waste, waste concerning construction, furniture waste, waste from industry, etc.

As a general rule, the objects that are to be sorted are brought to a processing center in order to be valorized, for example in order to be recycled. Note that the objects to be sorted are typically arranged in bulk form or in piles, which can include a more or less large number of randomly entangled objects, in a particular and predefined zone of the processing center. Then, they are generally transferred to means of processing and other specific devices. Their transfer, from a particular and predefined zone of the processing center to the means for processing, is carried out by using known means of transfer, as for example, shovels or conveyors.

The method according to the invention is as such supplied by these means of transfer with objects to be sorted, said objects to be sorted being generally in the form of piles.

Then, the method according to the invention is implemented in order to identify and sort a succession of piles constituted of material objects of different natures, shapes and sizes.

The first step (a) of the method according to the invention consists in supplying a zone of vision with objects being generally in the form of piles, the zone of vision being in the zone of action of a robot provided with one or several gripping members.

The zone of vision of the method according to the invention can be confounded with the aforementioned predefined and particular zone of the processing center, with the objects to be sorted then being for example directly unloaded into this zone of vision by a collection vehicle.

The supplying of this zone of vision with objects can be carried out either according to a supply in batches, or according to a continuous supply.

In the sense of this application, a supply in batch means a supply by lot. In other terms, the supplying of the zone of vision is discontinuous. A single pile of objects at a time is processed. In this configuration, as long as all of the objects have not been sorted, the zone of vision is not supplied. But when the last object to be recovered contained beforehand in the pile is grasped by at least one gripping member of said robot, another pile is displaced into the zone of vision in order to be subsequently treated.

In the sense of this application, continuous supply means a supplying without deactivating the means that make it possible to provide the zone of vision with objects. In this configuration, objects to be sorted are displaced to the zone of vision continuously.

This zone of vision comprises at least two sensors for measuring electromagnetic radiation. It is also possible to add in this zone a source of incident electromagnetic radiation in order to allow for a level of emission of electromagnetic radiation that is sufficient by the pile of objects in order to capture images that are representative of the actual pile.

In this application, the sensors for measuring electromagnetic radiation are used to identify the nature of the unitary object located in said receiving zone.

Note that these sensors for measuring electromagnetic radiation can be directly fixed onto the articulated mechanical arm of the robot. In this configuration, the capture or captures of images, carried out by the sensors for measuring electromagnetic radiation, are carried out when the unitary object is under the control of one of the gripping members of the robot. In other terms, the attribution of a nature top the unitary object is carried out during its displacement between the zone of vision and the receiving zone. During this identification, it is therefore not necessary for the unitary object to be deposited in a particular zone.

In the sense of this application, unitary object means any object contained initially beforehand in the pile of objects to be sorted and which has been extracted therefrom.

The measurements taken by these sensors of electromagnetic radiation make it possible, step (b) of the method according to the invention, to carry out at least two two-dimensional images of the pile present in said zone of vision. These two-dimensional images make it possible to reconstruct one or several virtual or electronic images of the pile of objects in the zone of vision that can be viewed on a screen.

The transformation of the measurements of electromagnetic radiation into a two-dimensional image is made possible by the use of calculating software.

These two-dimensional images are analyzed and processed, step (c) of the method according to the invention, with the purpose of identifying all of the possible gripping zones for the gripping member or members of the robot and for identifying the gripping member that is most suited for each one of the possible gripping zones, said zones being associated with objects present in the pile.

Note that by gripping zone, or specific zone, in the sense of this invention, refers to a zone that can be gripped by any gripping member of a robot. Note also that several gripping zones can be associated with one object contained in the pile.

The processing of these two-dimensional images can, for example, be carried out using calculating software and image processing software.

After all of the gripping zones have been identified thanks to the processing and to the analyses of the two-dimensional images, the gripping zones are located in position and in orientation, step (d) of the method according to the invention.

Then, according to the method of the invention, the nature of the object gripped or that is to be gripped by the robot is attributed between the steps (e) and (i), and consists in capturing at least one two-dimensional image using at least one two-dimensional image sensor and in diffusing one at least of the two-dimensional images on a display screen that can be observed by an operator, with the operator attributing a nature to a viewed unitary object.

According to a first advantageous embodiment of the method of the invention, the step consisting in defining the nature of the unitary object grasped is carried out in the receiving zone, and more particularly between the steps (h) and (i) mentioned hereinabove.

According to this first embodiment, the choosing of one of the gripping zones, step (e) of the method according to the invention, can advantageously be carried out automatically thanks to the use of an algorithm.

Advantageously, the selecting of a specific zone is carried out thanks to the use of an automaton, which therefore does not require the intervention of an operator.

Note that during this gripping, the gripping trajectory of the robot can be calculated by using calculating software. Furthermore, a particular gripping trajectory can be associated to each gripping zone. The method is then advantageous due to the fact that it is possible to grasp and deposit a unitary object quickly.

After the robot has gripped the gripping zone defined by the algorithm using one of its gripping members, the unitary object associated with this gripping zone is transferred from the zone of vision to a receiving zone.

According to this first embodiment, the step consisting in defining the nature of the object in the receiving zone can be advantageously carried out by the capture of at least one two-dimensional image of the unitary object in the receiving zone using at least one measuring sensor of electromagnetic radiation and in diffusing one at least of these two-dimensional images of the unitary object on a display screen that can be observed by an operator, which in real time, attributes a nature to the unitary object viewed in the receiving zone. In this embodiment, the intervention of an operator is necessary.

Note that the various previously mentioned sensors for measuring electromagnetic radiation are chosen according to the source or sources of electromagnetic radiation used.

After the attribution of a particular nature to an object present in the receiving zone, this same object is displaced from the receiving zone towards an outlet according to the nature that was attributed to it beforehand.

According to a second advantageous embodiment of the method of the invention, the step consisting in defining the nature of the object gripped or to be gripped can be carried out between the steps (e) and (f) mentioned hereinabove, using the virtual image of the pile of objects of the step (b), which is diffused on at least one display screen that can be observed by an operator, said operator attributing a nature to said object to be gripped in the pile of objects viewed.

A nature is attributed to an object of the pile when the latter is located in the zone of vision. In this embodiment, the intervention of an operator is then necessary.

Advantageously, in a first step, one of the gripping zones can be targeted by an operator on the display screen diffusing said virtual image that represents the pile located in the zone of vision.

Then, in a second step, advantageously, the operator can attribute a nature to the preselected gripping zone, corresponding to a particular object, interactively thanks to the use of a touch-sensitive video screen, or of a video screen associated with a voice recognition system or with a system of the keyboard type or with any other system that allows for the particular selection of a specific zone.

According to this second advantageous embodiment of the method of the invention, after having attributed a particular nature to a gripping zone preselected by an operator, any one of the gripping members of a robot can grip this preselected gripping zone in order to displace the object from the zone of vision to the receiving zone.

As for the first embodiment of the invention, note that during the gripping, the gripping trajectory of the robot can advantageously be calculated by using calculating software. Furthermore, a particular gripping trajectory can be associated to each gripping zone. The method is then advantageous due to the fact that it is possible to grip and top deposit objects quickly.

After the robot has gripped said zone preselected by an operator by one of its gripping members, the unitary object, associated with this preselected gripping zone, is transferred from the zone of vision to a receiving zone.

In the framework of the second embodiment of the method according to the invention, an operator having attributed beforehand a nature to the object located in the receiving zone, the object can advantageously be displaced from the receiving zone to a predefined outlet according to this nature.

Note that regardless of the embodiment according to the invention, the zones of vision of the pile of objects and the receiving zone of the unitary object are separate zones, i.e. separate volumes of the processing center.

Note that according to the first advantageous embodiment of the invention, all of the objects contained in the initial pile are sorted, i.e. all of the objects are gripped by the robot and transit from the zone of vision to the receiving zone.

And according to the second advantageous embodiment of the invention, all of the objects contained in the initial pile are not necessarily sorted and do not necessarily transit from the zone of vision to the receiving zone.

In this case, an outlet intended to receive the objects not gripped by any gripping member can be placed in the vicinity of the zone of vision in order to allow it to be removed. In other terms, all of the objects that are not gripped by any one of the gripping members of the robot are displaced to a particular outlet through the use of any means of transfer.

This invention further has for object a selective sorting device, able to implement the previously described method, and comprising:

means for supplying a flow of objects having the form of a pile;

sensors for measuring electromagnetic radiation in order to carry out one or several two-dimensional images;

image processing and calculating software for processing the information resulting from said captured images and for identifying and for locating gripping zones of the objects of the pile;

a mechanical robot provided with at least one gripping member in order to grip an object defined by one or several gripping zones in the pile and displace it from a zone of vision to a receiving zone;

means for removing the object placed in the receiving zone;

means for diffusing one at least of said two-dimensional images on at least one display screen that can be observed by an operator, in such a way that said operator can attribute a nature to said object viewed.

The device according to the invention is advantageous because it allows for a selective sorting remotely by avoiding any contact between an operator and any object to be sorted. In this light, interfaces can be used in order to allow an operator to verify and control the selective sorting device remotely. Furthermore, the device according to the invention makes it possible to sort piles of objects that contain multiples material objects, in particular waste, that can be of different natures, sizes and shapes.

The device according to the invention comprises means that make it possible to supply a flow of objects having the form of a pile. For example, these means can be belt or roller conveyors, follower conveyors, ball tables, vibrating tables, mechanical devices comprising means for gripping, or any other device that makes it possible to displace a pile of objects from an initial point to another point. Collection bins wherein are placed the objects to be sorted can also be used. In this configuration, the bin is static during the sorting method as well as during the gripping of each one of the objects that it contains. However, as soon as the objects to be sorted contained in said bin have been sorted, a bin containing new objects to be sorted is conveyed to the zone of vision and as such replaces the first bin. It is also possible that the bin be filled directly by a collection truck which avoids replacing the bin.

The flow of objects supplies a zone of the device according to the invention, called zone of vision, with a pile of objects.

The device according to the invention further comprises a mechanical robot provided with at least one gripping member that makes it possible, in a first step, to grip an object contained in the pile present beforehand in the zone of vision, with each object of the pile being defined by one or several gripping zones, and in a second step to displace the gripped object from the zone of vision to another zone, called a receiving zone.

It is to be noted that after the choice of a particular gripping zone has been made, either by an automaton, or by an operator, the mechanical robot, by the intermediary of at least one of its gripping members, displaces the object associated with this particular gripping zone from the zone of vision to the receiving zone.

The device according to the invention comprises, in particular in the zone of vision, sensors for measuring electromagnetic radiation, that can be sensors of measurements in the visible or non-visible spectrum, such as gamma radiation sensors, radio electric sensors, infrared sensors, ultraviolet sensors, X-ray sensors or cameras.

Preferably, the sensors for measuring electromagnetic radiation are visible spectrum cameras. Note that the aforementioned sensors can also be used in combination.

These measurements of electromagnetic radiation allow the robot to grip a particular object by a preselected gripping zone. These measurements of electromagnetic radiation can also be analyzed and processed by calculating software and image processing software in order to allow for the identification and the locating of all of the possible gripping zones of each object contained in the pile.

That is why, the sensor or sensors for measuring electromagnetic radiation can advantageously be connected to means of image analysis.

Note that an object contained in the pile can be associated with several gripping zones or specific zones, with the calculating and image processing software having for objective to identify the gripping surfaces, not objects.

The measurements of electromagnetic radiation can allow for the elaboration of one or several two-dimensional images.

Preferably, the display screen whereon are diffused one or several of said two-dimensional images can be either touch-sensitive, or associated with a voice recognition system, or associated with a keyboard, or associated with several of the aforementioned systems in order to allow for the selection of a particular gripping zone by an operator.

The video screen can further comprise two zones:

a first zone which makes it possible to view an image coming from the sensors for measuring electromagnetic radiation, and as such allows for the selecting of a particular specific zone, and a second zone of the screen that comprises sub-categories corresponding respectively to predetermined natures in order to attribute a particular nature to the preselected specific zone.

Advantageously, the device can comprise means for processing and for calculating that can automatically associate to a gripping surface selected by an operator or an automaton, the member of the robot that is most suited.

Furthermore, the device can advantageously comprise means for processing and for calculating that can automatically define a trajectory for gripping an object by the compatible specific zone, preselected by an operator or an automaton, for a particular gripping member of a mechanical robot.

In this way, the path followed by any gripping member of the robot is optimized. It is the fastest possible and also the shortest possible.

Advantageously, the receiving zone can comprise one or several sensors for measuring electromagnetic radiation.

In the sense of this application, receiving zone means a zone of which the volume can be accessed by a robot such as described hereinabove.

In this way, the attribution of a nature to an object located in the receiving zone is carried out, in this configuration, by an operator.

To this effect, the sensors for measuring electromagnetic radiation used are sensors making it possible to reproduce one or several virtual or electronic images of the object located in the receiving zone. For example, these sensors can be infrared or near infrared radiation sensors, ultraviolet radiation sensors, X-ray sensors, sensors of electromagnetic radiation according to the visible or non-visible spectrum, gamma radiation sensors, laser scanning distance sensors, and more preferably sensors for measuring electromagnetic radiation are cameras for the visible spectrum. The aforementioned sensors can also be used in combination.

Preferably, the images recovered by one or several of the aforementioned sensors can be viewed on a touch-sensitive screen. This touch-sensitive screen can for example include two zones. A first zone can make it possible to view an image coming from the sensors for measuring electromagnetic radiation. A second zone of the screen comprises sub-categories corresponding respectively to predetermined natures.

In this configuration, an operator can attribute to the unitary object that he is viewing on said touch-sensitive screen a particular nature by selecting a particular sub-category.

According to another alternative, the video screen is not touch sensitive, but is associated with a voice recognition system or with a system of the keyboard type or with any other system making it possible to attribute a particular nature to the object viewed on said screen.

After a nature has been attributed to an object placed in the receiving zone, the gripped object is removed from said receiving zone to an outlet, by means of conveying according to the nature that was attributed to it.

These means of conveying can be belt or roller conveyors, follower conveyors, ball tables, vibrating tables, mechanical devices comprising means for gripping, or any other device that makes it possible to displace a unitary object from an initial point to another point. One of the advantageous means for conveying is the same mechanical robot used for displacing the object of the pile from the zone of vision to the receiving zone.

The object transiting on these means of conveying is displaced in a predefined outlet according to the nature that was attributed to it.

For example, the outlets can include manipulating arms or robots adapted to the characteristics of the objects to be extracted. These outlets can also include devices for the pneumatic ejecting thrown on the conveying belt, compressed air nozzles, routing systems, pushers using cylinders, traps, robots. Means of extraction that combine various aforementioned ejection devices can be applied.

In this way, the path followed by a gripping member of said robot is optimized, typically in order to be as fast as possible and also as short as possible.

Furthermore, the device according to the invention can include means for raising and following the movements and the positions of a particular object, between the gripping device of a robot and an outlet, according to time. These means can include sensors for measuring electromagnetic radiation such as mentioned hereinabove.

BRIEF DESCRIPTION OF THE DRAWINGS

Other characteristics and advantages of this invention shall appear more clearly when reading the following description given by way of a non-limiting example and made in reference to the annexed figures wherein.

The identical references shown in FIGS. 1 to 3B are identified by identical numerical references.

DESCRIPTION

In the examples shown hereinafter, for the purposes of information and in a non-limiting manner, in the two embodiments devices are used according to the invention shown in FIGS. 1 and 2, robotic solutions marketed by the company SILEANE or by the company AKEO. These devices include a robot that comprises a poly-articulated system provided with one or several gripping members able to grip an object by a specific zone. In order to facilitate the reading of the figures, a single gripping member is shown in the FIGS. 1 and 2.

However, preferably, the robot can include at least two gripping members, with the first using a technology referred to as "suction" and the other a technology referred to as "clamp". This robot is not the one shown in the figures.

Figure 1:
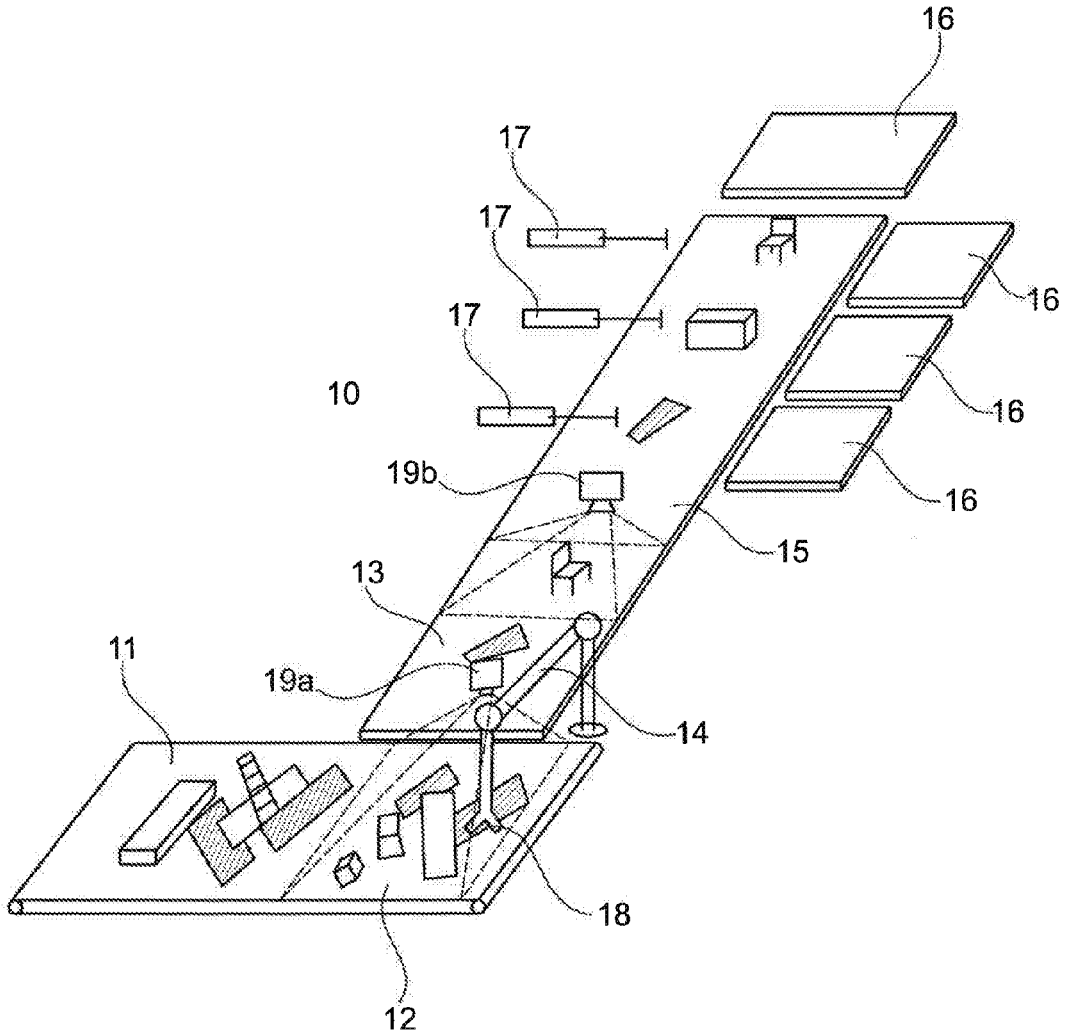
FIG. 1 shows an embodiment of a device according to the invention, seen in three dimensions, able to sort the objects of the pile selected automatically, according to the first embodiment of the method according to the invention.
Figure 2:
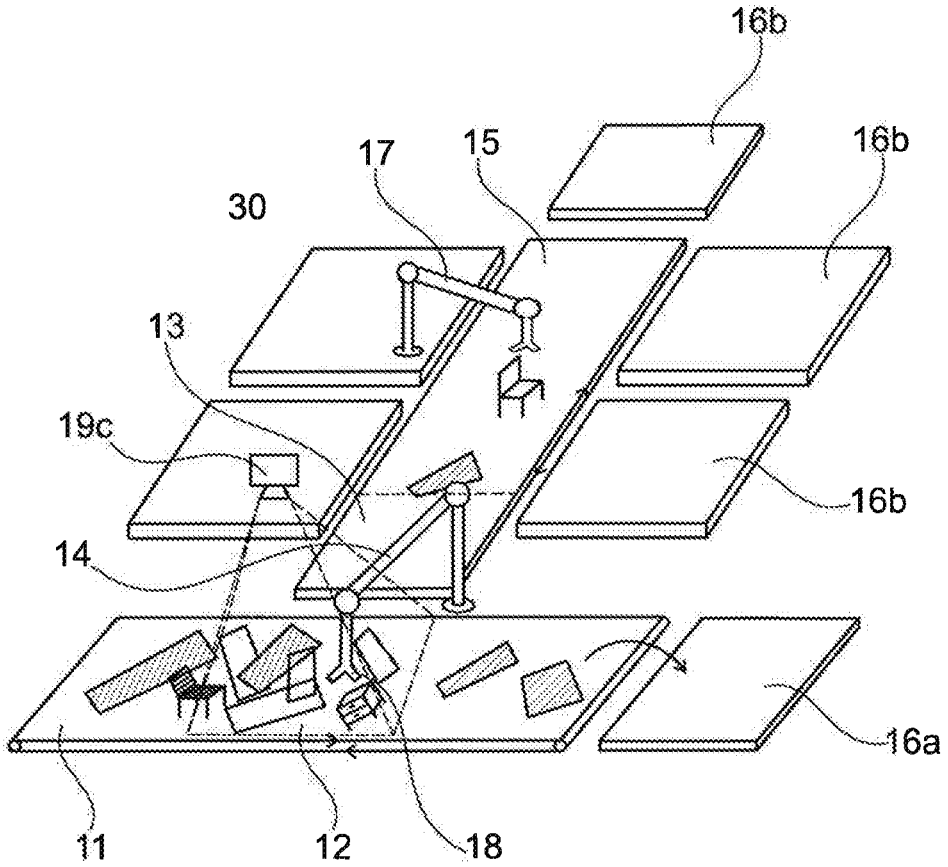
FIG. 2 shows an embodiment of a device according to the invention, seen in three dimensions, able to sort the objects of the pile selected by an operator, according to the second embodiment of the method according to the invention.

In FIGS. 1 and 2, the robot comprises a single gripping member that uses the "clamp" technology.

FIG.1 describes a device 10 according to the invention, making it possible to extract particular objects contained in a pile, according to their nature.

The pile of objects comprises a bulk volume of heterogeneous objects placed randomly in such a way that the objects are entangled.

As shown in FIG. 1, the pile of objects, for the purposes of its processing, is arranged on a first belt conveyor 11.

This first belt conveyor 11 is able to supply a zone, called the zone of vision 12, with a pile of material objects.

This zone of vision 12 is irradiated with an electromagnetic radiation using sources of radiation in order to carry out one or several images of the pile of objects located in the zone of vision 12.

Furthermore, the device of FIG. 1 comprises sensors for measuring electromagnetic radiation in order to carry out one or several two-dimensional images of the pile of objects located in the zone of vision 12.

In these conditions, the sensors for measuring electromagnetic radiation are configured to acquire successive two-dimensional images of the pile located in the zone of vision 12. Note that the images captured cover the entire pile of objects.

According to the device 10 of FIG. 1, the images are captured thanks to the use of a camera 19*a* in the visible spectrum.

One or several of said images of the pile of objects captured are then processed and analyzed in order to allow for the identification and the locating of each possible gripping zone by a gripping member 18 of the poly-articulated robot 14.

To do this, the sensors for measuring electromagnetic radiation are, for example, coupled to means for processing, which can be calculators and other software, configured to process the images coming from said sensors.

The combined uses of calculating software and of image processing software make it possible to choose a gripping zone and a gripping member.

According to the device 10 of FIG. 1, a gripping member 18 grips the defined gripping zone.

The device of FIG. 1 can furthermore use calculating and image processing software to also make it possible to define the fastest and shortest possible gripping trajectory, for a given gripping member 18.

Note that in order to allow for the obtaining of images that represent reality, the speed of the flow of objects being directed to the zone of vision 12, through the use of a belt conveyor 11 according to FIG. 1, is possibly not constant. For example, when a pile of objects reaches the zone of vision 12, the speed of the flow of the objects decreases, and is even cancelled, so that the sensors present in the zone of vision 12 can capture at least two two-dimensional images that represent the pile of objects.

After each gripping, the sensors capture new images of the pile of objects. In this way, the object to be gripped, which may have been displaced by the gripping of a preceding object, will even so be located and gripped.

On the order of an operator, the first belt conveyor 11 can resume operation in order to convey into this zone of vision 12 a new pile of objects to be sorted.

Then, in the device 10 of the invention shown in FIG. 1, it is not necessary for the image or images captured to be transferred on a video screen since the images captured beforehand are useful only for automatically identifying and locating each possible gripping zone by a gripping member 18.

Note that here, no operator intervenes. The choosing of any one of the gripping zones is carried out automatically according to various pre-established criteria.

Then, all of the objects contained in the initial pile are gripped by any gripping member 18, as shown hereinabove, and arranged, according to FIG. 1, in a receiving zone 13 located on a second belt conveyor 15.

Note that all of the objects contained in the initial pile to be sorted transit from the zone of vision to the receiving zone after having been gripped by the robot.

According to FIG. 1, to each object deposited in this receiving zone 13 is attributed a particular nature. This attribution is carried out thanks to the intervention of an operator who can use an interface. This interface allows said operator to attribute a nature to a given object, at a given instant.

The interface is coupled to one or several sensors for measuring electromagnetic radiation.

According to the device of FIG. 1, the two-dimensional image sensor is a camera 19*b* operating in the visible spectrum. This camera 19*b* is connected to a screen and the images captured appear on this screen. These images can be pre-processed by computer means in order to have a certain contrast for the operator and as such give him indications for example on the properties or the nature of said object (FIG. 3A).

For example, if an object is made of plastic, a color or a specific texture facilitating the recognition by the operator can be attributed to said object. This step is particularly interesting for materials of which the effectiveness in recognition is not of good performance.

Figure 3A:
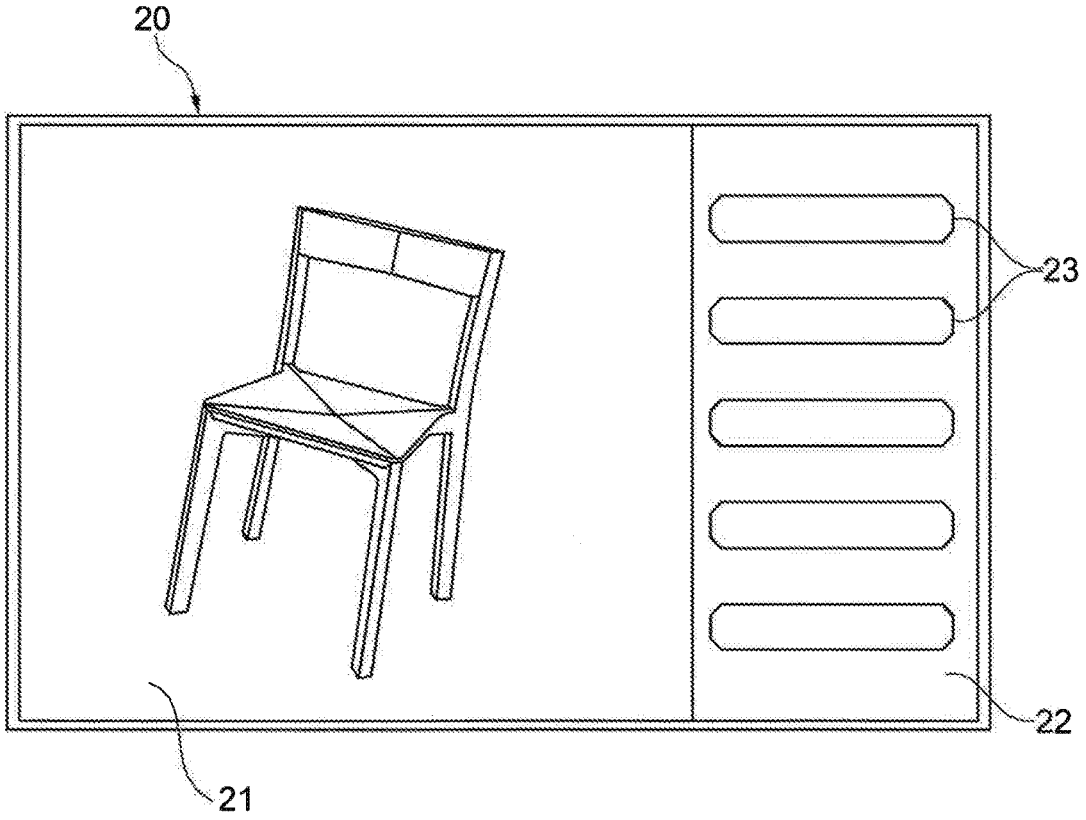
FIG. 3A shows a view of a touch-sensitive screen that can be viewed by an operator when the latter attributes a particular nature to an object that is presented in unitary form.

FIG. 3A shows a touch-sensitive screen 20 that can be viewed by an operator who wants to attribute a nature to a unitary object located in the receiving zone 13. On this screen, it is possible to view, on the one hand, the object located in the receiving zone 13, and on the other hand, to attribute to it a particular nature. To do this, the camera 19*b* is connected to a touch-sensitive screen 20, comprising two zones 21 and 22:

a first zone 21 in order to view an image coming from the camera 19*b*, and a second zone 22 of the screen, that comprises sub-categories 23 corresponding respectively to predetermined natures: for example, a first sub-category 23 corresponds to wood, a second sub-category 23 to scrap iron, a third sub-category 23 to plastic, a fourth sub-category 23 to debris.

The second zone of the screen can further comprise, a sub-category 23 that does not correspond to any other particular nature, but wherein an operator can class all of the objects indifferently of their nature. This sub-category 23 can then supplement the other sub-categories or be the only one available. In this latter case, optionally, it is possible to have only a single outlet 16*b* wherein are ejected all of the objects located on the second belt conveyor 15.

Note that the operator who carries out the operation of attributing a nature to a given object must be initiated to this task with the purpose of maintaining the flexibility and the productivity of the sorting method.

According to FIG. 1, after the attributing of a particular nature to an object, the object is directed towards a predefined outlet 16, in a first step, thanks to the use of a second belt conveyor 15 and in a second time thanks to the use of one or several means of extraction 17.

As shown in FIG. 1, the means of extraction 17 make it possible to extract the objects located on the second belt conveyor 15 and to convey them to the appropriate outlets 16 intended to receive them. FIG. 1 shows that these outlets 16 include pneumatic ejection devices that use cylinders.

Furthermore, means can be used to raise and follow the movements and the positions of a particular object, between the gripping device 18 of a robot 14 and an outlet 16, according to time.

Moreover, FIG. 2 describes a device 20 according to the invention making it possible to select in particular one or several objects contained in a pile, according to the second embodiment of the method according to the invention.

The pile of objects comprises a bulk volume of heterogeneous objects placed randomly in such a way that the objects are entangled.

As shown in FIG. 2, the pile of objects, for the purposes of its processing, is arranged on a first belt conveyor 11.

This first belt conveyor 11 is able to supply a zone, called the zone of vision 12, with a pile of material objects.

On the zone of vision 12 is located, according to the device 20 of FIG. 2, a camera 19*c* in visible spectrum, in order to carry out one or several two-dimensional images of the pile of objects located in the zone of vision 12.

Note that the images captured by the camera 19*c* cover the entire pile of objects.

Figure 3B:
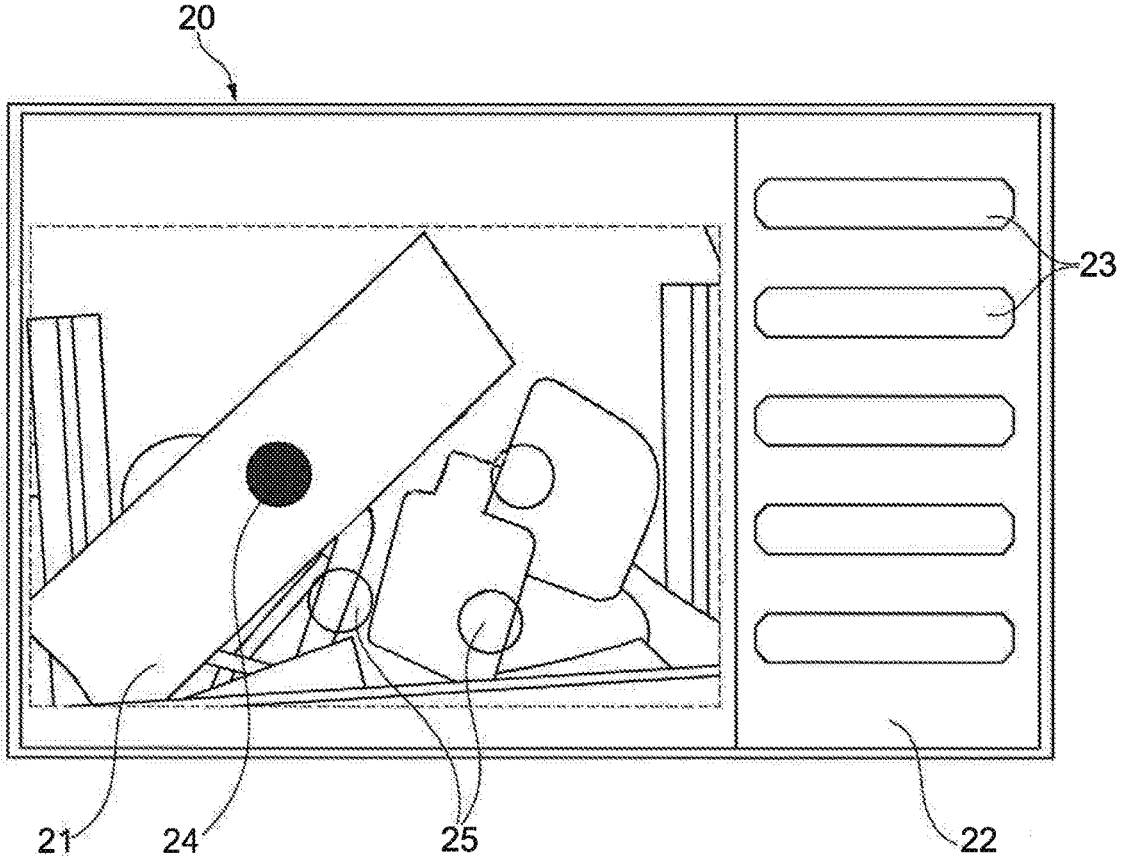
FIG. 3B shows a view of a screen that can be viewed by an operator when the latter selects a particular gripping zone and attributes a nature to it.

According to the device of FIG. 2, the camera 19*c* is connected to a screen and the images captured appear on this screen. These images can be pre-processed by computer in order to have a certain contrast for the operator and as such give him indications for example on the properties or the nature of said object selected by the designation of a particular gripping zone 25 (FIG. 3B).

For example, if an object is made of plastic, a color or a specific texture facilitating the recognition by the operator can be attributed to said object. This step is particularly interesting for materials of which the effectiveness in recognition is not of good performance.

In addition, the camera 19*c* is, for example, coupled to means of processing, which can be calculators and other software, configured to process the images coming from the camera 19*c* and to allow as such for the identification and the locating of all of the possible gripping zones associated with each one of the objects of the pile.

The screen whereon appear the images captured by the camera 19*c* is touch sensitive.

According to FIG. 3B, the touch-sensitive screen 20 comprises two zones 21 and 22:

a first zone 21 for viewing an image coming from the sensors for measuring electromagnetic radiation, and a second zone 22 of the screen, that comprises sub-categories 23 corresponding respectively to predetermined natures: for example, a first sub-category 23 corresponds to wood, a second sub-category 23 to scrap iron, a third sub-category 23 to plastic, a fourth sub-category 23 to debris.

The second zone of the screen can include, a sub-category 23 that does not correspond to any other particular nature, but wherein an operator can class all of the objects selected and contained beforehand in the pile. In this latter case, possibly, it is possible to have only a single outlet 16*b* wherein are ejected all of the objects that were deposited in the receiving zone 13 located on the second belt conveyor 15.

In FIG. 3B, the possible gripping zones are shown, on the first zone of said touch-sensitive screen 20, by virtual circles. In this configuration, an operator can designate a gripping zone 25 by pointing the finger on the touch-sensitive screen 20.

According to this configuration, the selection of a gripping zone 25 can be corrected. For example, selecting again a gripping zone 25 that is already selected deselects it.

In this configuration, an operator can attribute a nature to a given object.

Note that the operator who is carrying out the operation of attributing a nature to a given object must be initiated to this task with the purpose of maintaining the flexibility and the productivity of the sorting method.

With this configuration, an operator can, consequently, in a first step select a possible gripping zone 25, and in a second step he can attribute to this gripping zone 25 a particular nature.

The attribution of a nature to a particular gripping zone 25 is carried out as follows. An operator first selects a gripping zone 25 then he selects a sub-category 23 of attribution. According to this configuration, the gripping zone 25 chosen is marked with a graphic sub-reference as for example a colored circle 24.

A mode of operation can also be defined as a unitary category, i.e. a single category is automatically assigned to all of the objects designated by an operator after having selected a possible gripping zone 25 of an object contained in the pile. In this case the unitary category is defined beforehand by the operator.

Note that the objects not gripped by any gripping member 18 subsist in the zone of vision 12, before the first belt conveyor 11 resumes operation. In this way, the objects that remain in this zone of vision 12 are directed to a common outlet 16*a* located at the end of the first belt conveyor 11.

After the objects have been gripped, they are in unitary form in the receiving zone 13.

Note that when the objects are arranged in the receiving zone 13, a nature has been attributed to each object.

As soon as an object is deposited in the receiving zone 13, it is displaced from this receiving zone 13 by a second belt conveyor 15.

Indeed, as this second belt conveyor 15 is operating permanently, an object gripped by a gripping member 18 of a robot 14, then deposited on this second belt conveyor 15, is very quickly placed into motion. In this way, each one of the objects gripped in the initial pile is in succession all throughout this second belt conveyor 15.

The second belt conveyor 15 therefore makes it possible to extract the unitary object deposited beforehand in the receiving zone 13.

Since each object has been attributed to a nature, each one of them can therefore be displaced into a specific outlet 16*b*.

According to FIG. 2, the outlet 16*b* comprises a robot provided with a gripping member able to grip any object located on the second belt conveyor 15 and to displace it into a predefined outlet 16*b* according to the nature that was attributed to it. The robot 14 is used as a means of extraction 17.

Optionally, it is possible to have only a single outlet 16*b* wherein are ejected all of the objects located on the second belt conveyor 15.

Furthermore, means can be used to raise and follow the movements and the positions of a particular object, between the gripping device 18 of a robot 14 and an outlet 16*b*, according to time.

This invention is not limited to the embodiments described hereinabove.

The invention claimed is:

1. A method for selectively sorting in order to identify and sort material objects of waste material, of different natures, shapes and sizes and having the form of a pile, the method comprising the following steps:

a. supplying a flow of objects in the form of a pile, to a zone of vision comprising at least two sensors for measuring electromagnetic radiation, the zone being located in a zone of action of a robot provided with at least one gripping member;

b. capturing at least two two-dimensional images of the pile contained in the zone of vision using the sensors for measuring electromagnetic radiation, in order to reconstruct a virtual or electronic image of the pile of objects in the zone of vision that can be viewed on a screen;

c. processing the information resulting from the two-dimensional images, and identifying possible gripping zones associated with objects present in the pile for the gripping member or members of the robot without seeking to know the nature of the objects;

d. locating, in position and orientation, the possible gripping zones;

e. choosing one of the gripping zones;

f. defining automatically, for a given gripping member, a trajectory for gripping a unitary object corresponding to the chosen gripping zones;

g. grasping the corresponding unitary object according to the defined trajectory;

h. displacing the grasped unitary object to a receiving zone;

i. displacing the unitary object located in the receiving zone to an outlet according to the nature;

wherein the nature of the object gripped or that is to be gripped by the robot is attributed between the steps (e) and (i), and includes capturing at least one two-dimensional image wherein the object appears, using at least one sensor for electromagnetic radiation and diffusing at least one of the two-dimensional images on a display screen that can be observed by an operator, the operator attributing a nature to the object viewed.

2. The selective sorting method according to claim 1, wherein the step of attributing a nature to the unitary object grasped is carried out between step (h) the step (i), in the receiving zone.

3. The selective sorting method according to claim 2, wherein the step of attributing a nature to the unitary object located in the receiving zone is carried out by the capture, by at least one sensor for electromagnetic radiation, of at least one two-dimensional image diffused on a display screen that can be observed by an operator.

4. The selective sorting method according to claim 1, wherein the choosing of one of the gripping zones of step (e) is carried out automatically.

5. The selective sorting method according to claim 1, wherein the step of attributing a nature to the object that is to be gripped is carried out between step (e) and (f).

6. The selective sorting method according to claim 5, wherein the step of attributing a nature to the object that is to be gripped is carried out using a virtual or electronic image of the pile of objects of the step (b), which is diffused on at least one display screen that can be observed by an operator, the operator attributing a nature to the object to be gripped in the pile of objects viewed.

7. The selective sorting method according to claim 1, wherein one of the gripping zones is targeted by an operator on the display screen diffusing the virtual image.

* * * * *